US009065168B2

(12) United States Patent
Chun et al.

(10) Patent No.: US 9,065,168 B2
(45) Date of Patent: Jun. 23, 2015

(54) ANTENNA APPARATUS FOR PORTABLE TERMINAL

(75) Inventors: Jae-Bong Chun, Gyeonggi-do (KR); Sung-Cheol Kim, Gyeonggi-do (KR); Jae-Ho Lim, Gyeonggi-do (KR); Kyung-Jong Lee, Gyeonggi-do (KR); Austin Kim, Gyeonggi-do (KR); Jae-Ho Lee, Gyeonggi-do (KR)

(73) Assignee: Samsung Electronics Co., Ltd., Yeongtong-gu, Suwon-si, Gyeonggi-do (KR)

( * ) Notice: Subject to any disclaimer, the term of this patent is extended or adjusted under 35 U.S.C. 154(b) by 230 days.

(21) Appl. No.: 13/275,701

(22) Filed: Oct. 18, 2011

(65) Prior Publication Data

US 2012/0098709 A1 Apr. 26, 2012

(30) Foreign Application Priority Data

Oct. 20, 2010 (KR) ..... 10-2010-0102263

(51) Int. Cl.

| | |
|---|---|
| ***H01Q 1/24*** | (2006.01) |
| ***H01Q 9/04*** | (2006.01) |
| ***H01Q 1/38*** | (2006.01) |
| ***H01Q 1/48*** | (2006.01) |
| ***H01Q 5/378*** | (2015.01) |

(52) U.S. Cl.

CPC ..... *H01Q 9/0421* (2013.01); *H01Q 1/243* (2013.01); *H01Q 1/38* (2013.01); *H01Q 1/48* (2013.01); *H01Q 5/378* (2015.01)

(58) Field of Classification Search

USPC ..... 343/702, 700 MS, 848, 720

See application file for complete search history.

(56) References Cited

U.S. PATENT DOCUMENTS

| | | | | |
|---|---|---|---|---|
| 6,867,736 | B2 * | 3/2005 | Faraone et al. | 343/700 MS |
| 7,551,142 | B1 * | 6/2009 | Zhang et al. | 343/702 |
| 2006/0139214 | A1 * | 6/2006 | Deng et al. | 343/700 MS |
| 2007/0171131 | A1 * | 7/2007 | Sorvala et al. | 343/700 MS |
| 2008/0100519 | A1 | 5/2008 | Ku | |
| 2008/0106478 | A1 | 5/2008 | Hill | |
| 2008/0180333 | A1 * | 7/2008 | Martiskainen et al. | 343/722 |
| 2008/0316115 | A1 | 12/2008 | Hill et al. | |
| 2009/0153407 | A1 | 6/2009 | Zhang et al. | |

(Continued)

FOREIGN PATENT DOCUMENTS

| | | | |
|---|---|---|---|
| EP | 1 286 413 | A1 | 2/2003 |
| EP | 2 109 185 | A1 | 10/2009 |
| GB | 2 293 275 | A | 3/1996 |

(Continued)

OTHER PUBLICATIONS

Hill, Robert J., et al.; Patent Application Publication No. US 2010/0007564 A1; Publication Date: Jan. 14, 2010; "Antennas For Handheld Electronic Devices With Conductive Bezels;" . . . .

*Primary Examiner* — Hoang V Nguyen
*Assistant Examiner* — Hai Tran
(74) *Attorney, Agent, or Firm* — Cha & Reiter, LLC

(57) ABSTRACT

An antenna apparatus for a portable terminal which is light, thin, compact, and small. The antenna apparatus preferably includes a main board equipped with a power feeding part for feeding power and a ground surface for grounding the main board and at least one sub-board, each sub-board which has a ground surface and electrically communicates with the main board, wherein the ground surface of each sub-board receives power from the power feeding part of the main board and resonates.

18 Claims, 13 Drawing Sheets

(56) References Cited

U.S. PATENT DOCUMENTS

2009/0256758 A1 10/2009 Schlub et al.
2009/0315789 A1* 12/2009 Sung et al. ..... 343/702

FOREIGN PATENT DOCUMENTS

JP 2008-124797 5/2008 ..... H01Q 9/30
KR 10-2010-0017788 A 2/2010

* cited by examiner

ANTENNA APPARATUS FOR PORTABLE TERMINAL

CLAIM OF PRIORITY

This application claims the benefit under 35 U.S.C. §119 (a) from a Korean patent application filed in the Korean Intellectual Property Office on Oct. 20, 2010 and assigned Serial No. 10-2010-0102263, the entire disclosure of which is hereby incorporated by reference in its entirety.

BACKGROUND OF THE INVENTION

1. Field of the Invention

The present invention relates to an antenna apparatus for a portable terminal. More particularly, the present invention relates to an antenna apparatus for a portable terminal, which is light, thin, compact, and small.

2. Description of the Related Art

Portable terminals such as mobile communication terminals (cellular phones), electronic schedulers, tablet computers, personal digital assistants, and other personal complex terminals have become necessities of modern-day society thanks to the development of the electronic communication industry. Such portable terminals have developed into important means of information transmission, and the capabilities of these portable terminals are rapidly changing. In this light, even though additional functionality has been added to the portable terminal, their physical structure in general has become lighter, thinner, more compact, and overall smaller than portable terminals from previous generations of devices.

As described above, in general it is difficult to mount a plurality of elements on the limited space of the portable terminal, particularly as the public demands lighter, thinner, more compact, and smaller devices.

In general, the portable terminal includes an antenna apparatus to perform RF communication with a base station. The antenna apparatus includes an antenna radiator for transmitting and receiving signals in a corresponding service band. The larger the antenna radiator, the better is the antenna performance. However, it is becoming more and more difficult to secure a mounting space of the antenna radiator in the ever-increasing limited space of portable terminals in consideration of the many different elements being added thereto.

SUMMARY OF THE INVENTION

An exemplary aspect of the present invention is to provide at least some the advantages described below by providing an antenna apparatus for a portable terminal, which is light, thin, compact, and small.

Another exemplary aspect of the present invention is to provide an antenna apparatus for a portable terminal that is capable of being easily implemented at reduced costs.

Another exemplary aspect of the present invention is to provide an antenna apparatus for a portable terminal that implements a ground surface and a metal body, (such as a metallic case frame), that is equipped in the portable terminal as antenna radiators.

In accordance with an exemplary aspect of the present invention, an antenna apparatus for a portable terminal preferably includes a main board equipped with a power feeding part for feeding (i.e. distributing) power and a main board ground surface for grounding the main board, and at least one or more sub-boards, each of the sub-boards which has a sub-board ground surface and electrically communicates with the main board, wherein the sub-board ground surface of each of the sub-boards receives power from the power feeding part of the main board and resonates.

In accordance with another exemplary aspect of the present invention, a built-in antenna apparatus for a portable terminal preferably includes a main board equipped with a power feeding part for feeding power and a ground surface for grounding the main board, at least one or more sub-boards, each of the sub-boards which has a ground surface, electrically communicates with the main board, and is spaced apart from the main board in a horizontal or vertical direction to the main board, and a metal member installed in the portable terminal, wherein the ground surface of the main board, the ground surface of the sub-board, and the metal member are electrically connected for arrangement with a slot part of an open-loop shape or a closed-loop shape that is surrounded by metal and wherein the slot part receives power from the power feeding part of the main board and resonates.

Other exemplary aspects, advantages and salient features of the invention will become more apparent to those skilled in the art from the following detailed description, which, taken in conjunction with the annexed drawings, discloses exemplary embodiments of the invention in more detail.

BRIEF DESCRIPTION OF THE DRAWINGS

The above and other exemplary aspects, features and advantages of certain exemplary embodiments of the present invention will be more apparent from the following detailed description taken in conjunction with the accompanying drawings, in which.

DETAILED DESCRIPTION

The following detailed description, with reference to the accompanying drawings, is provided to assist a person of ordinary skill in the art with a comprehensive understanding of exemplary embodiments of the present invention as defined by the claims. The description includes various specific details to assist the artisan in that understanding, but these details are to be regarded as merely exemplary. Accordingly, those of ordinary skill in the art will recognize that various changes and modifications of the exemplary embodiments described herein can be made without departing from spirit of the invention and the scope of the appended claims. Also, descriptions of well-known functions and constructions may be omitted for conciseness and so as not to obscure appreciation of the present invention by a person of ordinary skill by including such well-known functions and constructions.

The terms and words used in the following description and claims are not limited to their bibliographical meanings, but are used by the inventor to enable a clear and consistent understanding of the invention. Accordingly, it should be apparent to those skilled in the art that the following description of exemplary embodiments of the present invention are provided for illustrative purposes only and not for the purpose of limiting the invention as defined by the appended claims.

It is to be understood that the singular forms "a", "an", and "the" include plural references unless the context clearly dictates otherwise. Thus, for example, reference to "a component surface" typically includes reference to one or more of such surfaces.

The term "substantially" typically means that the recited characteristic, parameter, or value need not be achieved exactly, but that deviations or variations, including for example, tolerances, measurement error, measurement accuracy limitations and other factors known to skill in the art, may occur in amounts that do not preclude the effect the characteristic was intended to provide.

Preferred exemplary embodiments of the present invention will now be described below with reference to the accompanying drawings.

The present invention described hereinafter relates to an antenna apparatus for a portable terminal. Particularly, the prevent invention relates to an antenna apparatus for a portable terminal, which is light, thin, compact, small in overall size and capable of being easily implemented (installed in the portable terminal) and thereby reducing overall expenses. An antenna apparatus for a portable terminal according to one exemplary embodiment of the present invention may implement a ground surface and a metal body such as a metallic case frame as antenna radiators.

Figure 1:
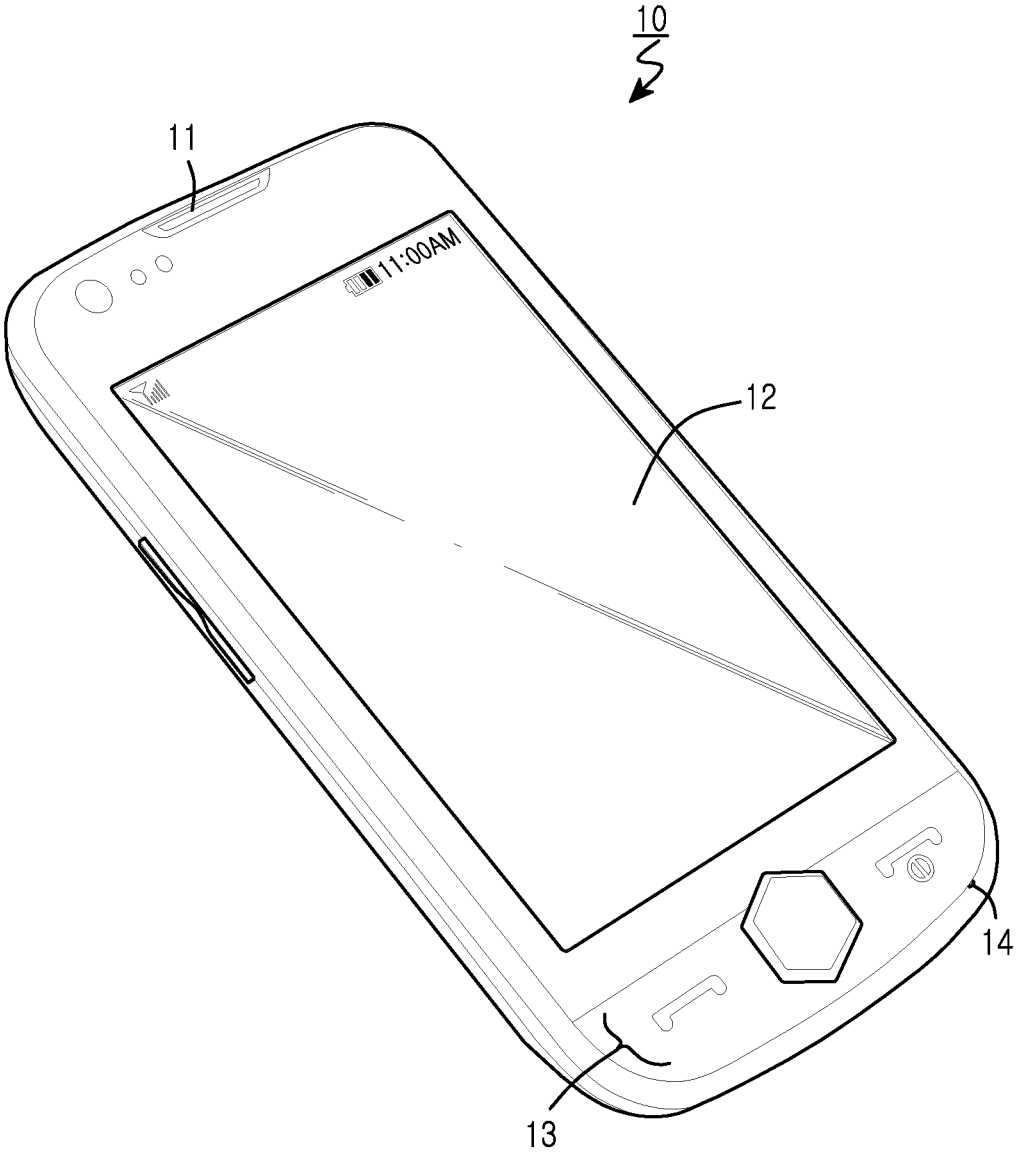
FIG. 1 is a perspective view of a portable terminal according to one exemplary embodiment of the present invention.

FIG. 1 is a perspective view of a portable terminal according to one exemplary embodiment of the present invention.

Referring now to FIG. 1, the portable terminal denoted by 10 includes a speaker 11 for outputting an audio signal, a display 12 for outputting a video signal being typically positioned underneath the speaker 11. In addition, the portable terminal 10 preferably includes a keypad assembly 13 which is a data input means having a series of switches or sensors that close upon downward pressure or sense touch of the particular area, and a microphone 14, positioned under the keypad assembly 13, for inputting an audio signal. The display 12 may comprise a Liquid Crystal Display (LCD) having many millions of pixels, or an organic light-emitting diode (OLED) display or an active-matrix organic light-emitting diode (AMOLED) display, or any other thin-film technology screen. Also, if the LCD is provided as a touch screen, the display 12 may perform a function of a data input unit adjunctively or instead of the keypad assembly 13.

More particularly, the portable terminal 10 preferably includes an antenna apparatus (such as in one of the examples shown in FIGS. 2 through 7) for transmitting and receiving wireless signals. The antenna apparatus implements at least one or more ground surfaces installed in the portable terminal as antenna radiators. For example, the antenna apparatus may comprise a ground surface of a board installed in the keypad assembly 13 of the portable terminal 10 as an antenna radiator. Accordingly, the antenna apparatus according to an exemplary embodiment of present invention is light, thin, compact, and small, capable of being easily implemented and reducing manufacturing costs. In addition, the present invention may be applied to terminals such as a slide-type terminal and a folder-type terminal as well as a bar-type terminal shown in FIG. 1, or any other type of personal or mobile communication device.

The portable terminal according to an exemplary embodiment of the present invention has a main board. The main board is a board equipped with basic circuits and components. The main board sets an execution environment of the portable terminal and maintains information about the setting of the execution environment. The main board allows the portable terminal to be safely driven, and smoothly performs data input and output of all devices installed in the portable terminal. The main board includes a controller (Central Processing Unit (CPU)), a microprocessor, a coprocessor (optional), a memory, a Basic Input Output System (BIOS), a connection circuit, etc. Also, the portable terminal has a sub-board which is electrically connected to the main board. The sub-board can comprise a Printed Circuit Board (PCB) or a Flexible Printed Circuit Board (FPCB) which is equipped with basic circuits and components. The sub-board may be inserted into a connector means installed in the main board or may be soldered to the main board. For example, the sub-board may be a Rigid-Flexible (RF) board. The main board and the sub-board may be installed, but are not limited to, on one dielectric board. The main board and the sub-board are preferably manufactured together.

The sub-board communicates a signal with the main board. In other words, the sub-board may provide an input signal for a corresponding operation to the main board. Also, the sub-board may receive a signal from the main board and may perform a corresponding operation. The sub-board may independently operate from the main board. However, in general, the sub-board operates under control of the main board. For example, the sub-board may be a board for any one of a speaker, a keypad, a microphone, a receiver, a Liquid Crystal Display (LCD), etc., just to name some possibilities.

In general, the main board has a ground surface for reducing a harmful element such as noise. The sub-board also has a ground surface. An antenna apparatus according to one embodiment of the present invention to be described later uses a ground surface installed in the portable terminal as an antenna radiator.

Figure 2A:
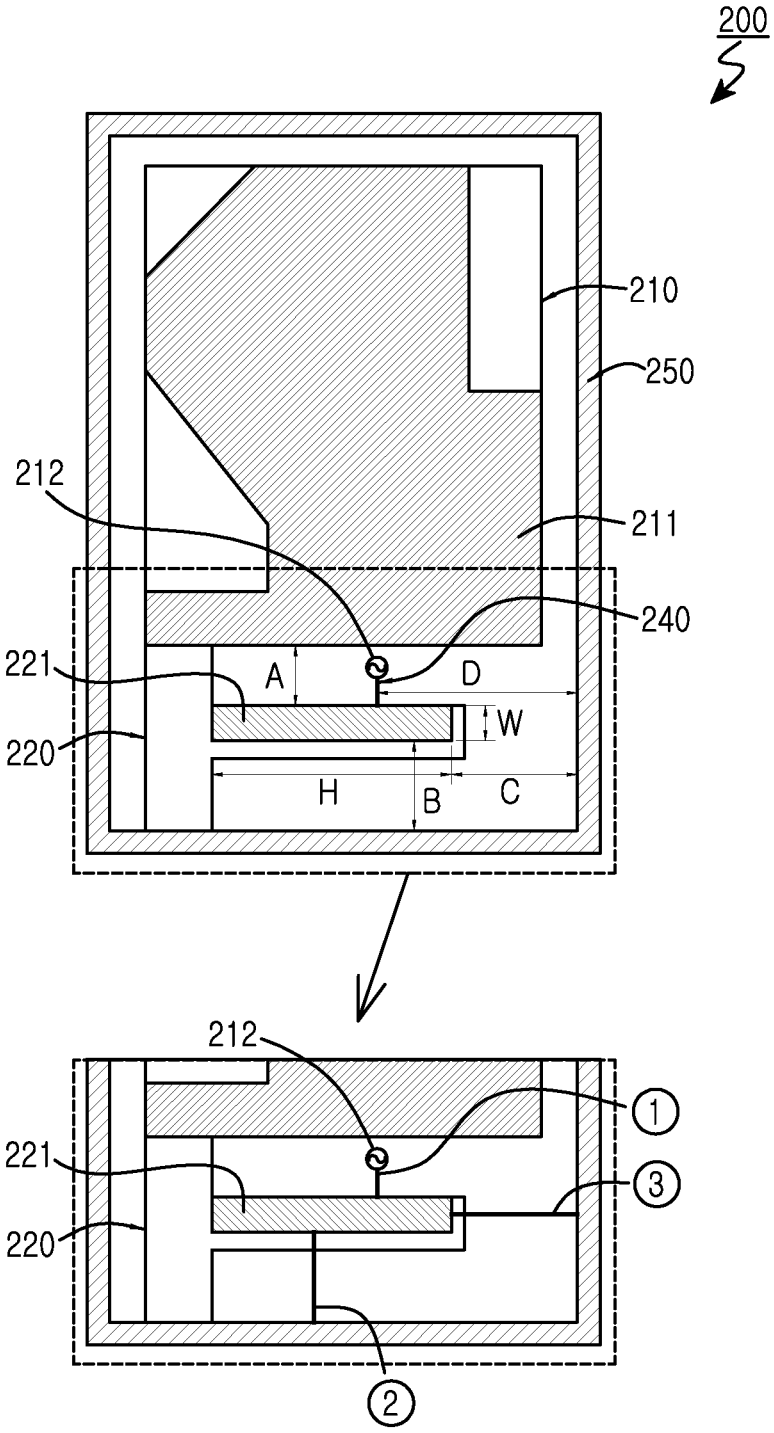
FIG. 2A and FIG. 2B illustrate a structure of an antenna apparatus of a portable terminal according to one exemplary embodiment of the present invention.

FIG. 2A illustrates a structure of an antenna apparatus for a portable terminal according to an embodiment of the prevent invention.

Referring now to FIG. 2A, an antenna apparatus 200 of a portable terminal according to an exemplary embodiment of the present invention includes a main board 210 equipped with a power feeding part 212 for feeding power and a ground surface 211 for grounding the main board, at least one or more sub-boards, each of the sub-boards which has a ground surface 221 and electrically communicate with the main board 210, and a connection means 240 for electrically connecting the power feeding part 212 of the main board 210 with the ground surface 221 of the sub-board 220. The connection means 240 supplies current output from the power feeding part 212 of the main board 210 to the ground surface 221 of the sub-board 220. The ground surface 221 of the sub-board 220 which receives current may radiate radio waves. As shown in FIG. 2A, the ground surface 221 of the sub-board 220 is spaced apart from the main board 210 in a horizontal direction to the main board 220. The ground surface 221 of the sub-board 220 may be spaced apart from the main board 210, and the arrangement is not limited to a direction vertical to the main board 210.

In addition, the antenna apparatus 200 according to an exemplary embodiment of the present invention includes a metal case frame 250 which permits portable terminal to radiate radio waves there through. In other words, the metal case frame 250 may receive current from the main board 210 or the sub-board 220 and may radiate radio waves. The metal case frame 250 may be completely or partially comprised of metal.

More particularly, as shown in ① of FIG. 2A, the main board 210 and the ground surface 221 of the sub-board 220 may be electrically connected. The antenna apparatus 200 has, but is not limited to, a variety of positions for feeding power to the ground surface 221 of the sub-board 220. Furthermore, as shown in ② or ③ of FIG. 2A, the ground surface 221 of the sub-board 220 and the metal case frame 250 may be electrically connected. In other words, the metal case frame 250 may radiate radio waves together with the ground surface 221 of the sub-board 220. It is not shown in FIG. 2A. However, the metal case frame 250 may be electrically connected to the power feeding part 212 of the main board 210 and may radiate radio waves.

For convenience, the ground surface 221 of the sub-board 220 has a square shape with a length H and a width W. However, the ground surface 221 of the sub-board 220 may be any one of a variety of different shapes. Also, the ground surface 221 of the sub-board 220 is spaced apart from the ground surface 211 of the main board 210 by a distance A, and is spaced apart from the metal case frame 250 by distances B and C. In addition, the connection means 240 is spaced apart from the metal case frame 250 by a distance D. The antenna apparatus 200 according to one exemplary embodiment of the present invention may have a variety of resonant characteristics using the distances A, B, C, D, H, and W as distance variables. This is also applied to FIG. 2B to FIG. 7C to be described later.

Figure 2B:
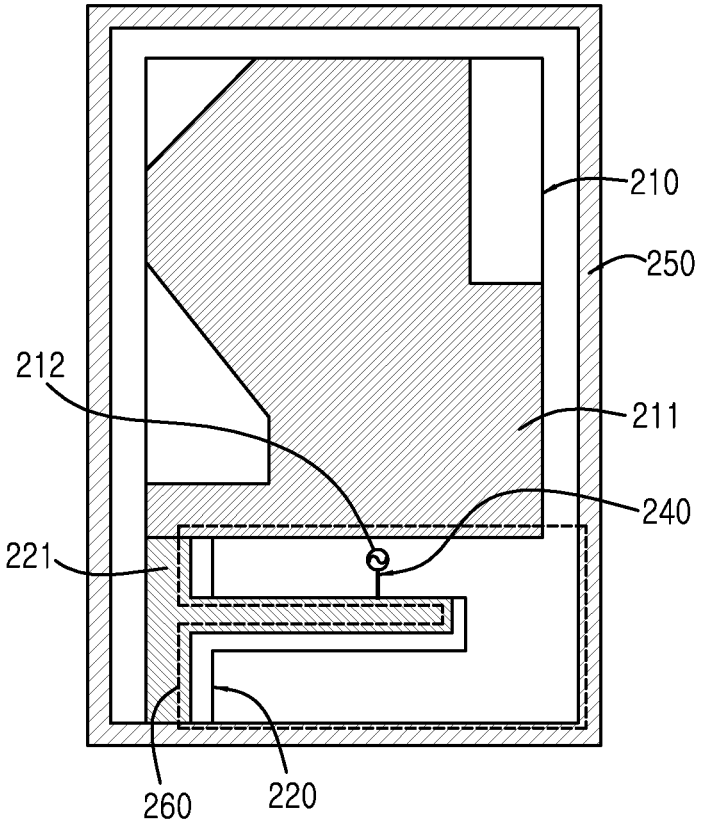

FIG. 2B illustrates a structure of an antenna apparatus for a portable terminal according to another exemplary embodiment of the present invention. Similar contents described above are not repeated in this example.

Referring now to FIG. 2B, the ground surface 221 of the sub-board 220 has a "T" shape. Also, the antenna apparatus 200 according to this exemplary embodiment of the present invention includes a "C"-shaped or "U"-shaped slot part 260 formed by combination of the ground surface 211 of the main board 210, the ground surface 221 of the sub-board 220, and the metal case frame 250. In general, the slot part 260 is a thin and long groove which is surrounded by metal. The ground surface 211 of the main board 210, the ground surface 221 of the sub-board 220, and the metal case frame 250 are electrically connected with one another to be equipped with the slot part 260. For example, parts where the ground surface 211 of the main board 210, the ground surface 221 of the sub-board 220, and the metal case frame are in contact with each other may be electrically connected using soldering. At least two of the ground surface 211 of the main board 210, the ground surface 221 of the sub-board 220, and the metal case frame 250 are assembled to be equipped with the slot part 260.

With continued reference to FIG. 2B, a power feeding line electrically connects the power feeding part 212 of the main board 210 with the ground surface 221 of the sub-board 220. The power feeding line is disposed on the slot part 260.

The connecting means 240 is disposed across the slot part 260. The connecting means 240 supplies current output from the power feeding part 212 of the main board 210 to the ground surface 221 of the sub-board 220. The sub-board ground surface 221 of the sub-board 220 which receives current resonates, preferably so as to radiate electromagnetic waves. The electromagnetic waves are preferably radio waves. More particularly, the ground surface 221 of the sub-board 220 radiates radio waves, the slot part 260 may radiate radio waves by being electromagnetically coupled thereto. Therefore, the antenna apparatus 200 according to an exemplary embodiment of the present invention may have a matching or substantially matching resonant characteristic regarding the main ground surface 211 of the main board 210, the ground surface 221 of the sub-board 220, the metal case frame 250, and the slot part 260 installed by the combination of them. Typically, the matching resonant characteristic is a value of impedance at desired frequency or range of frequencies of electromagnetic waves which is desired to cause the antenna apparatus to radiate radio waves.

FIG. 3A to FIG. 3D illustrate an antenna apparatus schematically according to an exemplary embodiment of the present invention.

Figure 3A:
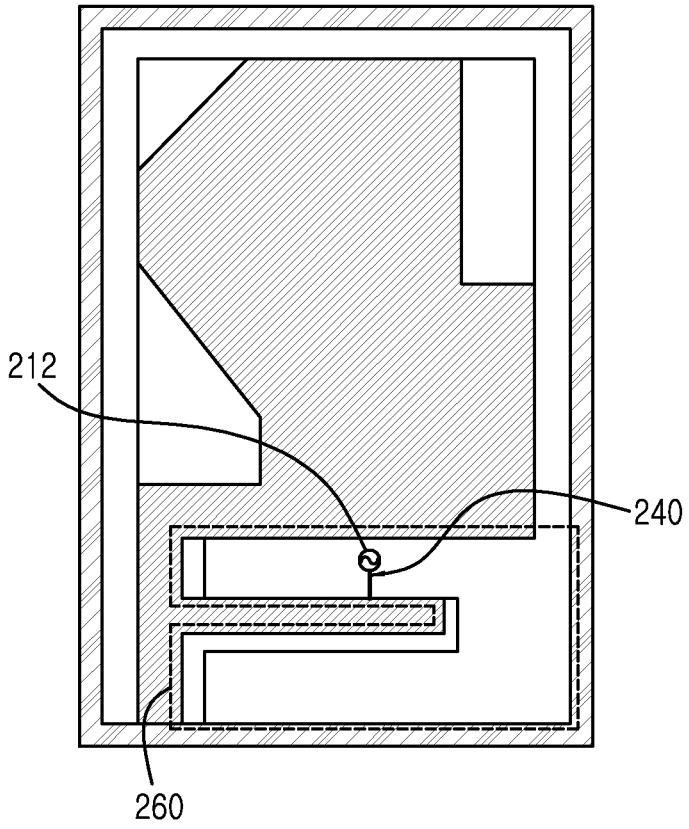
FIG. 3A to FIG. 3D illustrate an antenna apparatus for a portable terminal schematically according to one exemplary embodiment of the present invention.

Referring now to FIG. 3A, a case frame which forms the appearance of a portable terminal is non-metal. The ground surface 211 of the main board 210 and the ground surface 221 of the sub-board 220 are electrically connected to be equipped with the "C"-shaped or "U"-shaped slot part 260 which is opened.

Figure 3B:
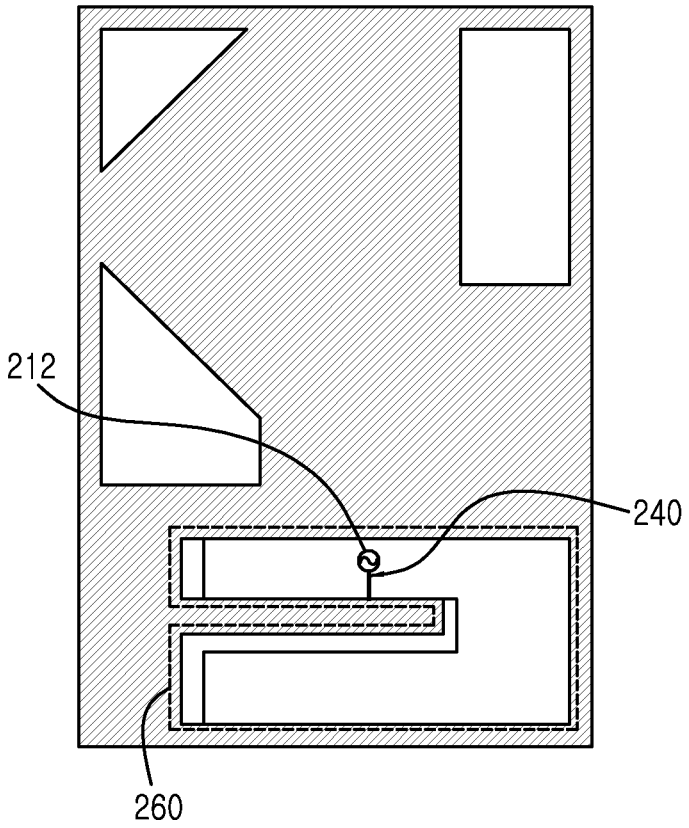
Figure 3C:
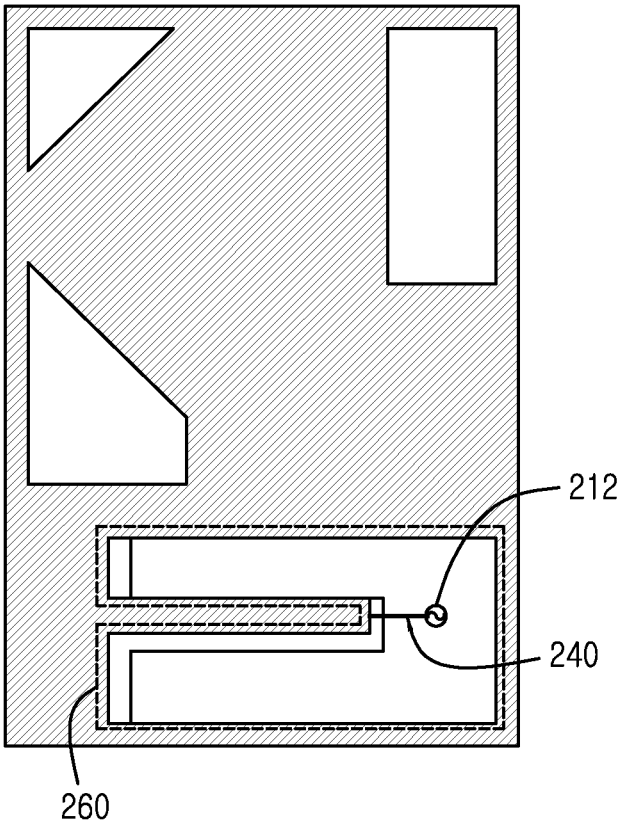
Figure 3D:
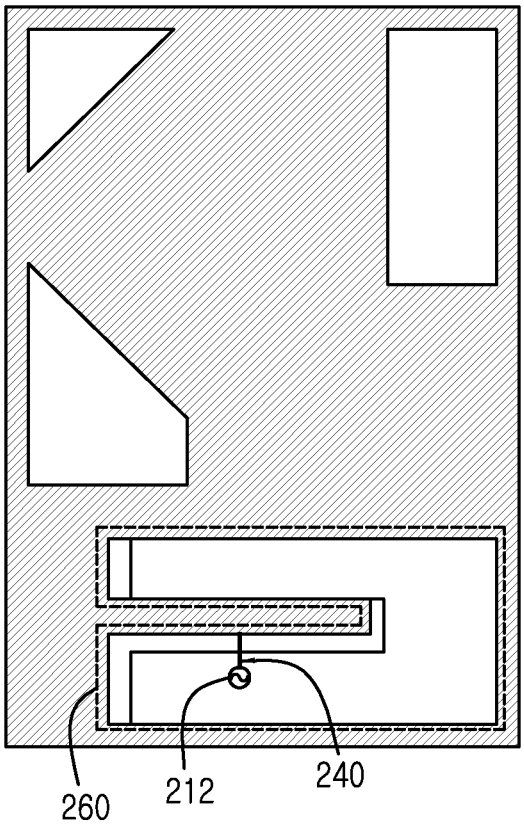

Referring now to FIG. 3B to FIG. 3D, the metal case frame 250 which forms the appearance of a portable terminal, the ground surface 211 of the main board 210, and the ground surface 221 of the sub-board 220 are electrically connected to be equipped with the "C"-shaped or "U"-shaped slot part 260. In addition, there are a variety of positions for feeding power to the ground surface 221 of the sub-board 220. A resonant characteristic differs according to the power feeding positions.

Figure 4:
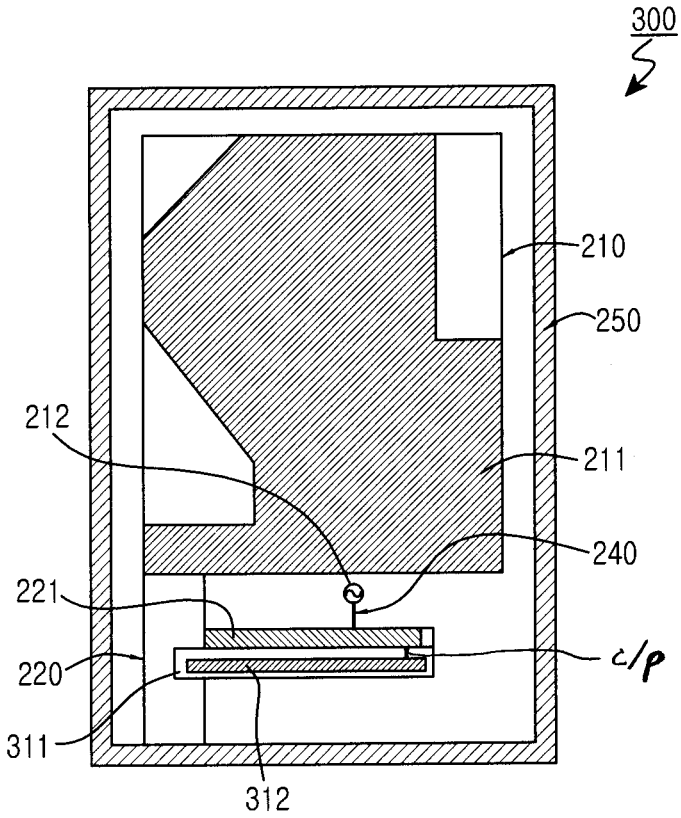
FIG. 4 illustrates a structure of an antenna apparatus for a portable according to another exemplary embodiment of the present invention.
Figure 4:
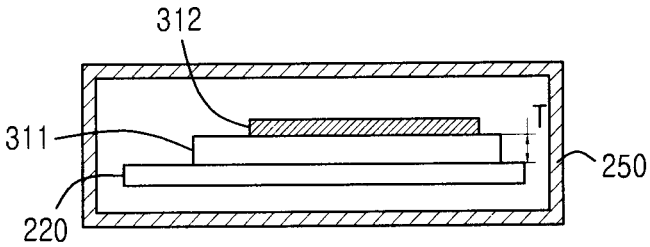

FIG. 4 illustrates a structure of an antenna apparatus for a portable terminal according to another exemplary embodiment of the present invention. Previously-described contents similar to the above embodiments are omitted.

Referring now to FIG. 4, an antenna apparatus 300 according to another exemplary embodiment of the present invention may include an insulating carrier 311 mounted on the sub-board 220 and a first metal plate 312 having a certain predetermined pattern, attached on the insulating carrier 311, for receiving current from the sub-board 220 and radiating radio waves. The insulating carrier 311 has a thickness T at which the ground surface 221 of the sub-board 220 and the first metal plate are spaced apart from each other. In addition, the metal case frame 250 may receive current from the main board 210, the sub-board 220, or the first metal plate 312 and may resonate. The ground surface 221 of the sub-board 220 and the first metal plate 312 may be electrically and directly connected, or may be connected through a C-clip or a pogo pin "c/p". As described above, the connection means 240 is disposed across the slot part 260. The connection means 240 supplies current output from the power feeding part 212 of the main board 210 to the ground surface 221 of the sub-board 220. The ground surface 221 of the sub-board 220 which receives current resonates, and the slot part 260 may resonate electromagnetically. In addition, the first metal plate 312 and the metal case frame 250 may also receive current and may radiate radio waves. Accordingly, the antenna apparatus 300 according to another exemplary embodiment of the present invention has a resonant characteristic in which the ground surface 211 of the main board 210, the ground surface 221 of the sub-board 220, the metal case frame 250, the slot part 260 installed by the combination of them, and the first metal plate 312 are matched with one another. For example, the first metal plate 312 may compensate for mismatched resonance.

Figure 5:
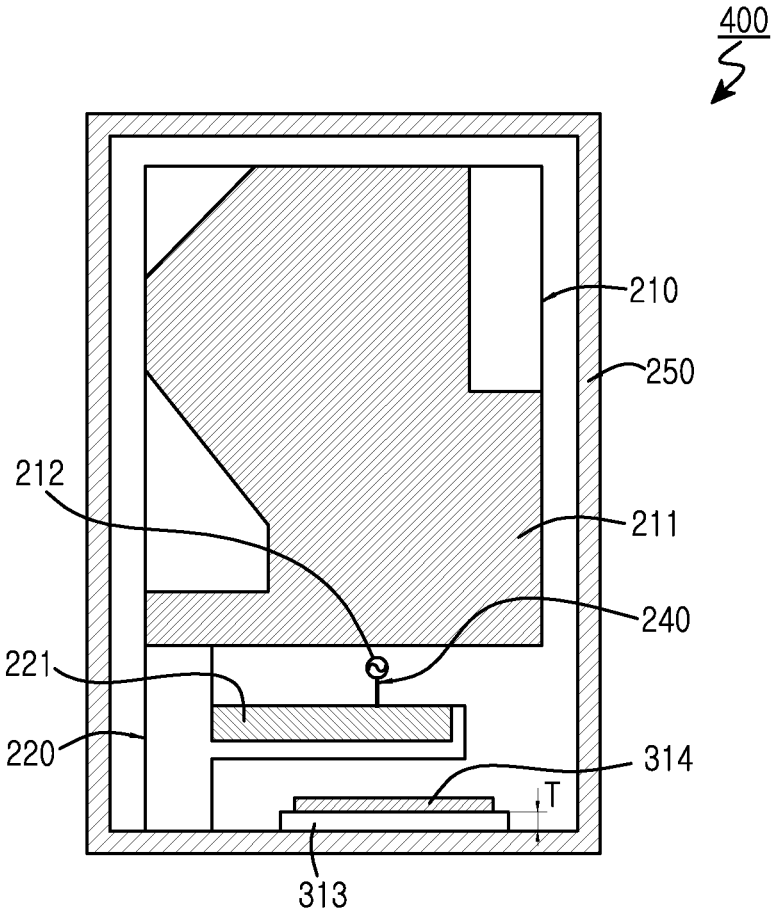
FIG. 5 illustrates a structure of an antenna apparatus for a portable according to another exemplary embodiment of the present invention.

FIG. 5 illustrates a structure of an antenna apparatus for a portable terminal according to another exemplary embodiment of the present invention. Previously-described contents of previous exemplary embodiments above are omitted from this explanation.

Referring now to FIG. 5, an antenna apparatus 400 according to another exemplary embodiment of the present invention may include an insulating carrier 313 which is mounted on the metal case frame 250 and a second metal plate 314 of a certain pattern, attached on the insulating carrier 313, for receiving current from the main board 210, the sub-board 220, or the metal case frame 250 and radiating radio waves. The metal case frame 250 and the second metal plate 314 may be electrically and directly connected, or may be connected through a C-clip or a pogo pin. Also, the second metal plate 314 is spaced apart from the metal case frame 250 by a thickness T of the insulating carrier 313. In addition, the second metal plate 314 may be selectively positioned on upper, lower, left, and right inner surfaces of the metal case frame 250 through the insulating carrier 313. The antenna apparatus 400 according to another exemplary embodiment of the present invention has a resonant characteristic in which these radiation elements are matched with one another. For example, the second metal plate 314 may compensate for mismatched resonance.

Figure 6:
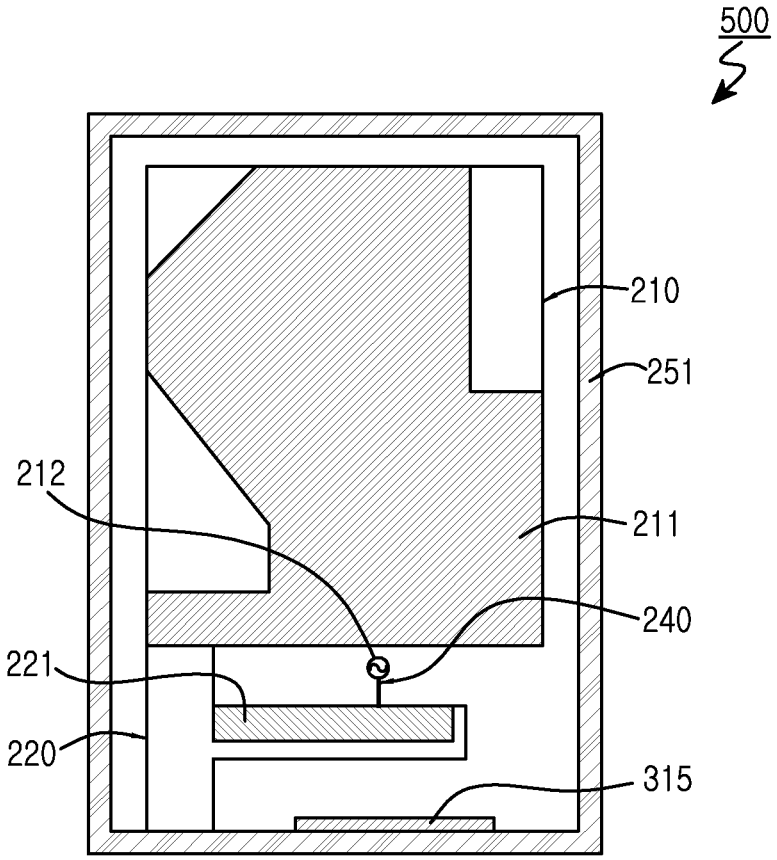
FIG. 6 illustrates a structure of an antenna apparatus for a portable according to another exemplary embodiment of the present invention.

FIG. 6 illustrates a structure of an antenna apparatus for a portable terminal according to yet another exemplary embodiment of the present invention.

Referring now to FIG. 6, an antenna apparatus 500 according to another exemplary embodiment of the present invention may preferably include a non-metal case frame 251 and a third metal plate 315, attached on the non-metal case frame 251, for receiving current from the main board 210 or the sub-board 220 and radiating radio waves. Also, the third metal plate 315 may be directly connected to the ground surface 221 of the sub-board 220.

The antenna apparatus 300 shown in FIG. 4 may have a different resonant characteristic based on the thickness T of the insulating carrier 311 and a position where the first metal plate 312 is attached on the sub-board 220. Also, the antenna apparatus 400 shown in FIG. 5 or the antenna apparatus 500 shown in FIG. 6 may have a different resonant characteristic according to a position where the second metal plate 314 or the third metal plate 315 is attached.

Figure 7A:
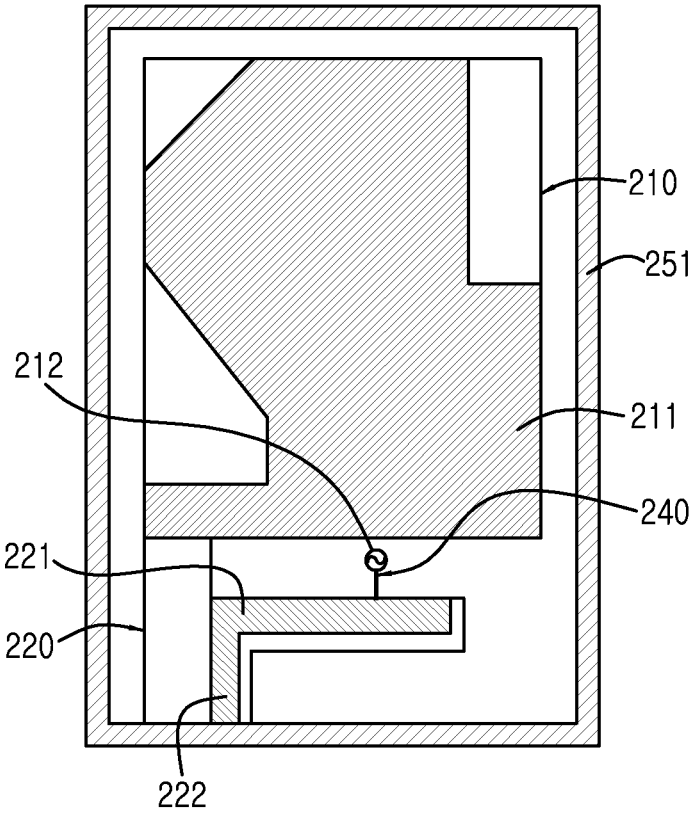
FIG. 7A and FIG. 7B illustrate examples in which a ground surface of a sub-board is formed of a variety of types.
Figure 7B:
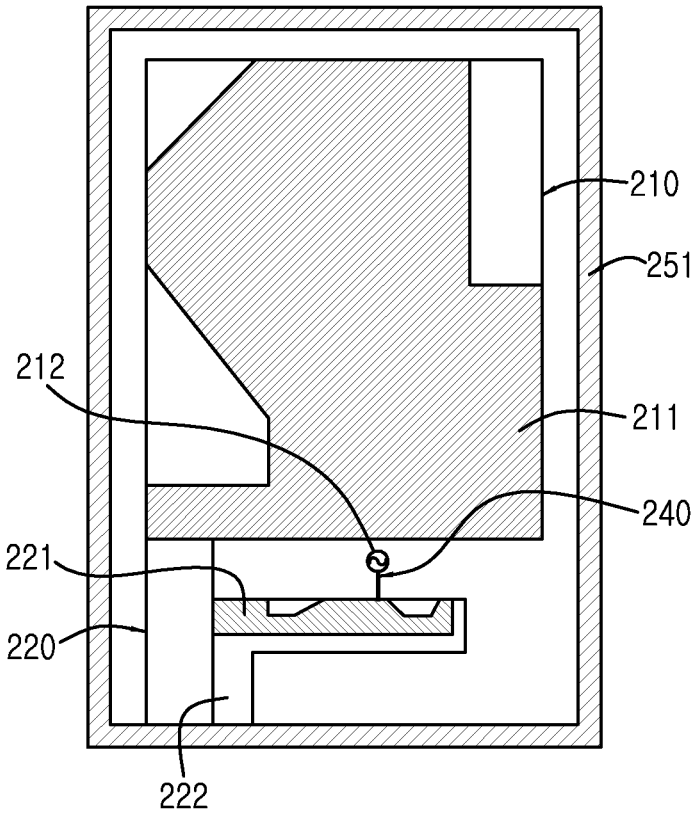
Figure 7C:
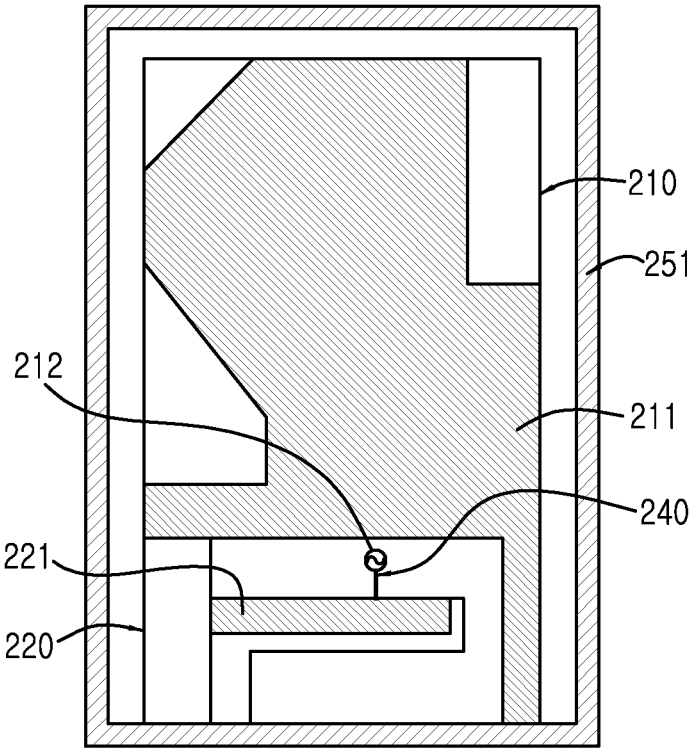
FIG. 7C illustrate an example in which a ground surface of a main board is extended and distinguishes from FIG. 2A and FIG. 2B.

FIG. 7A and FIG. 7B illustrate examples in which the ground surface of the sub-board is formed of a variety of types. Also, FIG. 7C illustrates an example in which the ground surface of the main board is extended to be different from FIG. 2A and FIG. 2B. Referring now to FIG. 7A to FIG. 7C, an antenna apparatus according to another embodiment of the present invention may have a different resonant characteristic by comprising the ground surface 221 of the sub-board 220 and the ground surface 211 of the main board 210 as a variety of types. For example, a shape of the slot part 260 may differ according to a shape of the ground surface 211 of the main board 210 or a shape of the ground surface 210 of the sub-board 220. In addition, the thickness T of the insulating carrier 311 or 313 shown in FIG. 4 or FIG. 5 is a factor for changing a resonant characteristic.

The antenna apparatuses of a variety of the exemplary embodiments shown in FIG. 1 to FIG. 7C may have a variety of radiation elements such as the ground surface of the sub-board, the metal case frame, the first to third metal plates, the slot part installed by the combination of them, etc. The variety of radiation elements are matched with one another and radiate radio waves in at least one or more resonant frequency bands. Also, the portable terminal may have a main antenna apparatus which radiates radio waves in a corresponding frequency band. The antenna apparatus according to any one of the plurality of exemplary embodiments of the present invention may radiate radio waves in a resonant frequency band which is the same as or different from that of the main antenna apparatus.

The antenna apparatus according to any one of the plurality of embodiments of the present invention feeds power to the ground surface of the sub-board which communicates with the main board and radiates radio waves. In addition, the antenna apparatus according to any one of the variety of embodiments of the present invention provides the first metal plate or the second metal plate, disposed on the insulating carrier fixed on the ground surface of the sub-board, which receives power from the sub-board and resonates. The antenna apparatus according to any one of the variety of embodiments of the present invention may feed power to the metal case frame which forms the appearance of the portable terminal and may resonate. In addition, the antenna apparatus according to any one of the plurality of exemplary embodiments of the present invention may feed power to the slot part installed by the combination of the ground surface of the main board, the ground surface of the sub-board, and the metal case frame and may resonate.

In conclusion, the antenna apparatus according to any one of the plurality of exemplary embodiments of the present invention may secure antenna performance in a limited space, may be easily implemented, and may reduce expenses.

While the present invention has been particularly shown and described with reference to exemplary embodiments thereof, it will be understood by those skilled in the art that various changes in form and details may be made therein without departing from the spirit and scope of the present invention as defined by the appended claims.

What is claimed is:

1. An antenna apparatus for a portable terminal, the apparatus comprising:

a main board including a power feeding part and a main board ground surface, the main board equipped with at least one circuit for control, processing or memory;

a metal case frame that encases the antenna apparatus and provides an external appearance of the portable terminal, wherein the metal case frame receives current from the main board or from the at least one sub-board and resonates;

at least one sub-board in electrical communication with the main board and including a sub-board ground surface, the at least one sub-board being disposed laterally with respect to the main board and having installed thereon circuitry for at least one of a microphone, a speaker, a receiver, a keypad, and a display; and a connection means for providing an electrical connection between the power feed part of the main board and the sub-board ground surface, wherein the sub-board ground surface of the sub-board is laterally spaced apart from the main board ground surface, the sub-board ground surface of the at least one sub-board receives power distributed from the power feeding part of the main board and resonates to radiate electromagnetic waves, and wherein the ground surface of the main board, the ground surface of the sub-board, and the metal member are electrically connected for arrangement with a slot part of an open-loop shape or a closed-loop shape that is surrounded by metal.

2. The antenna apparatus of claim 1, further comprising:

an insulating carrier mounted on the at least one sub-board; and a first metal plate disposed on the insulating carrier, for receiving current from the at least one sub-board and resonating.

3. The antenna apparatus of claim 2, wherein the first metal plate is electrically coupled with the sub-board ground surface.

4. The antenna apparatus of claim 3, wherein the first metal plate and the sub-board ground surface are electrically coupled using a C-clip or a pogo pin.

5. The antenna apparatus of claim 2, further comprising a metal case frame that encases the antenna apparatus and provides an external appearance of the portable terminal, wherein the metal case frame receives current from the first metal plate and resonates to radiate electromagnetic waves.

6. The antenna apparatus of claim 2, wherein the main board and the at least one sub-board are formed of one dielectric plate.

7. The antenna apparatus of claim 1, wherein the metal case frame is electrically and directly coupled with the power feeding part of the main board.

8. The antenna apparatus of claim 7, wherein the metal case frame is electrically coupled with the sub-board ground surface of the at least one sub-board.

9. The antenna apparatus of claim 1, wherein the connection means is a power feeding line disposed within the slot part.

10. The antenna apparatus of claim 1, further comprising:

an insulating carrier which is arranged on the metal case frame; and a second metal plate, disposed on the insulating carrier, for receiving current from the metal case frame and resonating.

11. The antenna apparatus of claim 1, further comprising a third metal plate having a predetermined pattern thereon and which is disposed on a non-metal case frame for providing an external appearance of the portable terminal, wherein the third metal plate receives current from the main board or the at least one sub-board and resonates.

12. The antenna apparatus of claim 1, wherein the sub-board ground surface of the at least one sub-board is spaced apart from the main ground surface of the main board in a vertical direction or a horizontal direction to the main ground surface of the main board.

13. The antenna apparatus of claim 1, wherein the at least one sub-board comprises a Rigid-Flexible (RF) board.

14. The antenna apparatus of claim 1, wherein the at least one sub-board is a Printed Circuit Board (PCB) or a Flexible Printed Circuit Board (FPCB) for at least one of the microphone, the speaker, the receiver, the keypad, and a Liquid Crystal Display (LCD).

15. A built-in antenna apparatus for a portable terminal, the apparatus comprising:

a main board including a power feeding part and a main ground surface, the main board equipped with at least one circuit for control, processing or memory; and at least one sub-board having a sub-board ground surface, the at least one sub-board being electrically connected with the main board, disposed laterally with respect to the main board, and having installed thereon circuitry for at least one of a microphone, a speaker, a receiver, a keypad, and a display;

a power feeding line for providing an electrical connection between the power feed part of the main board and a connection region on the sub-board ground surface, wherein the sub-board ground surface, at least at the connection region, is laterally spaced from the main board ground surface;

a metal case frame for forming the appearance of the portable terminal, and being electrically connected with the main board or the sub board, wherein the main ground surface of the main board, the sub-board ground surface of the sub-board, and the case frame are engaged with each other to form a slot part which is surrounded by metal, and wherein the slot part receives power from the power feeding part of the main board and resonates to radiate electromagnetic waves.

16. The built-in antenna apparatus of claim 15, wherein the connection region of the sub-board ground surface is a generally rectangular plate-like region protruding within the slot part.

17. The built-in antenna apparatus of claim 15, further comprising:

an insulating carrier which is arranged inside of the slot part or a position adjacent to the slot part; and a metal plate attached on the insulating carrier and receives current from the main board, the at least one sub-board, or the metal case frame and resonates to radiate electromagnetic waves.

18. The built-in antenna apparatus of claim 15, wherein the at least one sub-board comprises a printed circuit board or a flexible printed circuit board for any one of the microphone, the speaker, the receiver, the keypad, and an LCD.

* * * * *